United States Patent [19]

Wagner et al.

[11] 4,140,231

[45] Feb. 20, 1979

[54] VEHICLE FOR TRANSPORTING AND PLACING PORTABLE BRIDGE PARTS

[75] Inventors: Gerhard Wagner, Mainz-Lerchenberg; Eberhard Illgner, Nieder-Olm, both of Fed. Rep. of Germany

[73] Assignee: Magirus-Deutz Aktiengesellschaft, Ulm, Fed. Rep. of Germany

[21] Appl. No.: 833,673

[22] Filed: Sep. 15, 1977

[30] Foreign Application Priority Data

Sep. 17, 1976 [DE] Fed. Rep. of Germany ..... 2641807

[51] Int. Cl.[2] ..... B60P 1/52

[52] U.S. Cl. ..... 214/83.26; 214/84

[58] Field of Search ..... 214/83.26, 84, 520; 212/145; 280/262, 263, 264, 265, 266

[56] References Cited

U.S. PATENT DOCUMENTS

| | | | |
|---|---|---|---|
| 2,375,264 | 5/1945 | Wagner et al. | 212/145 |
| 2,812,071 | 11/1957 | Lanigan | 212/145 X |
| 3,326,397 | 6/1967 | Lippmann et al. | 214/83.26 |
| 3,825,107 | 7/1974 | Cary et al. | 214/83.26 X |
| 3,985,036 | 10/1976 | Decker et al. | 212/145 |

*Primary Examiner*—Albert J. Makay

*Attorney, Agent, or Firm*—Walter Becker

[57] ABSTRACT

A vehicle, especially a wheeled vehicle, for transporting and placing bridge parts of a portable bridge. The vehicle has a frame, on the forward end of which is mounted a cab. Behind the cab is mounted a support unit for use in placing the bridge parts. The support unit is pivotal about vertical axes and, during the placement process, is spaced from and in front of the cab and is located, in part, on the ground.

6 Claims, 4 Drawing Figures

VEHICLE FOR TRANSPORTING AND PLACING PORTABLE BRIDGE PARTS

The present invention relates to a vehicle, especially a wheeled vehicle, for transporting and placing bridge parts of a portable, quickly erectable bridge. The vehicle has a frame, on the forward end of which is mounted a cab, and behind which is mounted a placement device which has a placement beam, movable in the longitudinal direction of the vehicle, and on which the bridge parts are held in the transport position.

Vehicles of the above described type are known, for example, from German Offenlegungsschrift 19 38 940 and German Gebrauchsmuster 19 67 750. Both known vehicles have a placement device, by which the transported bridge parts can only be let down toward the back over the rear of the vehicle onto an obstacle or barrier. It is a drawback that for placement of the bridge, the vehicle must be backed up to the barrier. With the known placement vehicles, due to the poor view toward the back, such backing-up takes time and, in addition, when approaching steep banks, is dangerous. It must also be taken into consideration that, when placing a bridge on supports, to connect additional bridge parts to already placed bridge parts, the placement vehicle can similarly only get past these bridge parts by backing up. Due to the small (wheel) track, such a maneuver requires a high degree of driving skill.

In order to avoid these drawbacks, placement devices have been developed from which the bridges can be placed toward the front in the direction of travel of the vehicle. A particular problem has developed in this connection with the arrangement and housing of the supports required on the front for absorbing the tipping moment, since these supports either severly restrict the view of the driver or severely restrict the cross-country mobility of the vehicle.

It is, therefore, an object of the present invention to improve the heretofore known placement vehicles in such a way that, with regard to the arrangement of the supports on the vehicle, a placement of the bridge in the direction of travel is readily possible.

This object and other objects and advantages of the present invention will appear more clearly from the following specification in connection with the accompanying drawing, in which.

Figure 1:
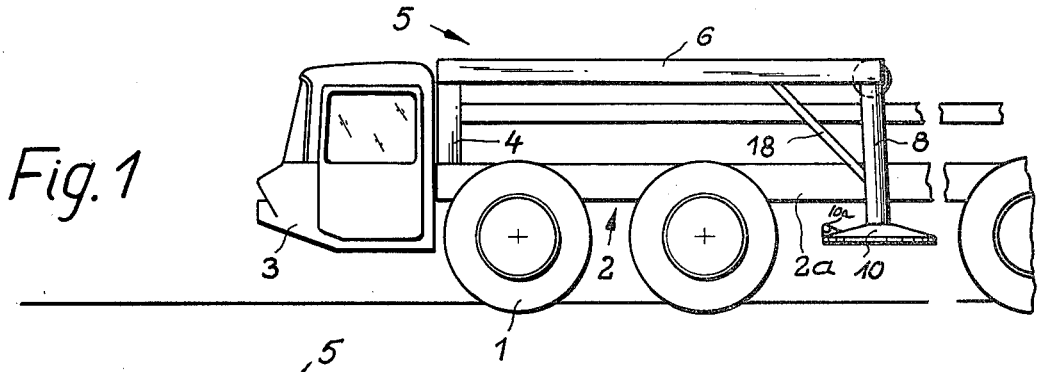
FIG. 1 is a side view of the placement vehicle according to the present invention with the support unit in the transport position.

The placement vehicle pursuant to the present invention is characterized primarily by a support unit which is mounted on the vehicle frame behind the cab. The present invention is further characterized in that, during the placement process, the support unit, as support for the placement device or the bridge parts, is spaced from and in front of the cab and is located on the ground.

In order that the support unit, during transport, can be housed within the confines of the vehicle, it is expedient that the support unit comprise two supports. Each support is mounted on a pivot or swivel arm which is pivotally mounted on the chassis frame on a cross member about a vertical axis directly behind the cab. The length of the swivel arms is such that the retracted supports are located between the front and rear axle units.

To stabilize the extended supports and the vehicle, it is advantageous if both supports are interconnected by a cross piece.

In order to avoid lateral movements of the bridge parts during their advancement over the support unit, two track rollers are mounted on the cross piece.

To save space and for technical reasons relating to placement, it is advantageous that the cross piece be arranged between the supports at the level of the two swivel arms and that it be pivotally connected to one swivel arm about a vertical axis of rotation. The connection with the other swivel arm is effected in a particularly simple manner by means of an automatic stop, the parts of which are arranged on the free end of the cross piece and on the inner side of the support of this other swivel arm.

Referring now to the drawing in detail, the wheeled vehicle 1, which may, for example, be a truck, serves to transport and place not shown bridge parts of a portable bridge. The vehicle 1 has a frame 2, on the forward end of which is mounted a lowered cab 3. In addition, a placement device known per se from, for example, U.S. Pat. Nos. 2,556,175; 3,492,683; and 3,925,840 and therefore not shown, is arranged on the chassis frame 2 behind the cab 3. The bridge parts are supported in the transport position on the placement device and are placed by the placement device over a barrier in the direction of travel. To support the bridge parts and during placement, also the vehicle, a support unit 5 is mounted on a cross member 4 on the chassis frame 2 behind the cab 3. The support unit 5 comprises two swivel arms 6 and 7, which are pivotally mounted about vertical axes on those ends of the cross member 4 which are located away from the longitudinal beams *2a*. On the free ends of the swivel arms 6,7, directed toward the ground, are fastened supports 8,9 which are hydraulic piston-cylinder drives. Plate-like base plates 10,11 are arranged on the downwardly withdrawable or extendible piston rods of the supports 8,9. Located on at least one of the base plates 10,11 is at least one nose 10*a* which is provided with an opening for receiving a hook to aid in pulling the base plates 10,11 out of mud or the like. The arrangement and length of the swivel arms 6,7 on the vehicle 1 are such that, in the transport position, the supports 8,9 are arranged behind the cab 3 within the confines of the vehicle and are secured in this position.

Figure 2:
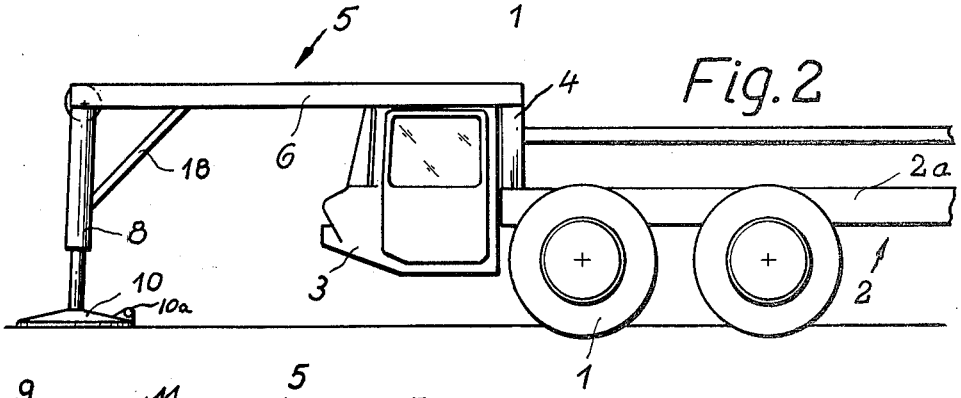
FIG. 2 shows the placement vehicle of FIG. 1, with the support unit swung out toward the front.

To place the bridge parts, the swivel arm 7 is first disconnected from the cross piece 13, whereupon the supports 8,9 are swung laterally out of the transport position toward the front in front of the cab 3 (FIG. 2). To stabilize the vehicle, the forward ends of the swivel arms 6,7 are again interconnected by the cross piece 13. The cross piece 13 is pivotally mounted on the swivel arm 6 about a hinge 14. The retraction and swinging out of the cross piece 13 is effected by means of the piston-cylinder drive 15. On the forward end of the swivel arm 7, on the inner side, is placed a stop 16 into which the free end of the cross piece 13 is swung with a correspondingly shaped counterpiece, thereby automatically locking the cross piece 13 in any convenient manner. A pair of track rollers 17 is mounted on the cross piece 13. Bridge parts can be advanced over and laterally guided by these track rollers 17.

Figure 3:
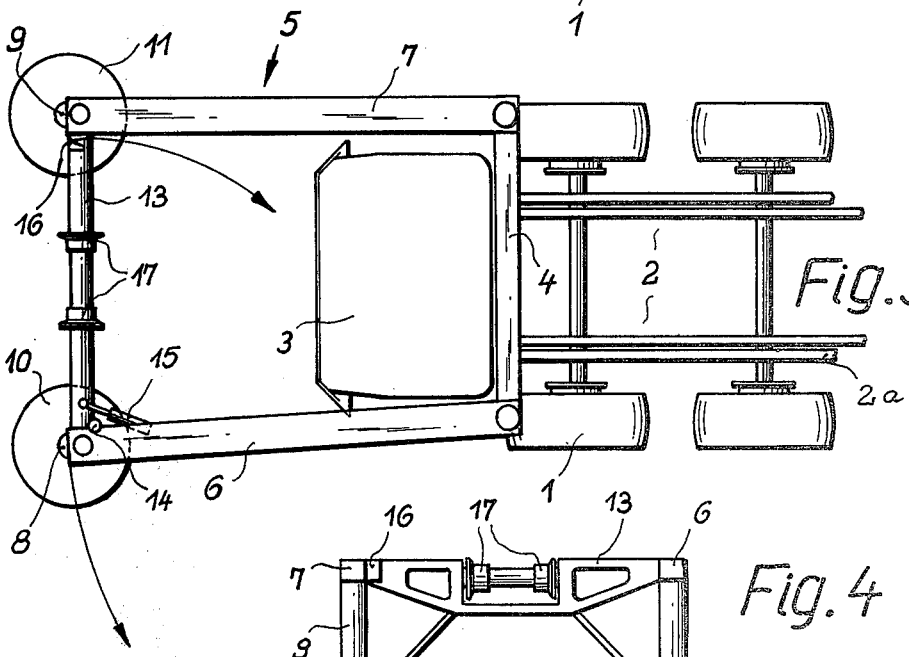
FIG. 3 is a top view of the support unit of FIG. 2.
Figure 4:
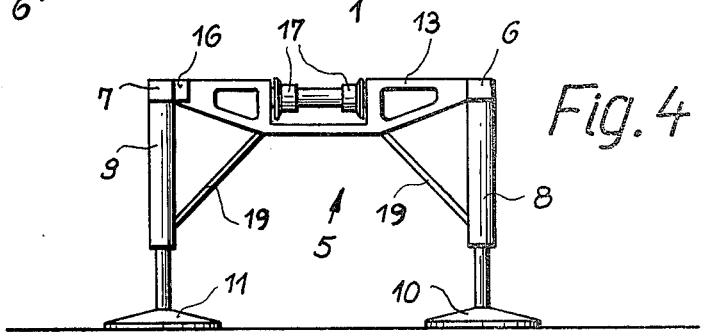
FIG. 4 is a front view of the support unit of FIG. 2, with the cab not shown.

Struts 18 located between the supports 8,9 and their swivel arms 6,7 additionally reinforce the support unit. As shown in FIGS. 2 and 3, the supports 8,9 in the operating position are at an angle to the swivel arms 6,7 in the direction of travel. Additional struts 19 may be located between the cross piece 13 and the supports 8,9.

The placement vehicle of the present invention has the advantage that the bridge parts can be placed toward the front over the front of and away from the vehicle. In this connection, due to the arrangement of the supports at a greater distance in front of the vehicle, a portion of the bridge load can be transmitted directly through the supports to the ground and, at the same time, the largest possible countermoment is achieved with the vehicle when moving the bridge toward the front. A further advantage of the present invention consists in that, while driving, the supports are positioned on the vehicle in such a way that they in no way impair the view of the driver or the cross country mobility of the vehicle.

It is, of course, to be understood that the present invention is by no means limited to the specific showing of the drawing, but also encompasses any modifications within the scope of the appended claims.

What we claim is:

1. A vehicle, especially a wheeled vehicle, for transporting and placing bridge parts of a portable bridge, which comprises in combination:

a frame;

a cab mounted on the forward end of said frame; and a support pivotally mounted on said frame for use in placing said bridge parts, said support unit in transport position being located behind said cab, and, in the placement position, being spaced from and in front of said cab and being adapted to contact the ground, said support unit being pivotal from said transport position to said placement position, and vice versa, said support unit comprising a cross member mounted on said frame directly behind said cab, two swivel arms respectively pivotally mounted on said cross member about vertical axes, and two supports, each of which is respectively mounted on one of said swivel arms, said supports being lowerable from a retracted position onto the ground for supporting said vehicle, and said vehicle has a front and rear axle unit located behind said cab, and in which said swivel arms are of such a length that, in the transport position, said supports are located between said front and rear axle units, and a crosspiece for selectively interconnecting and disconnecting said supports.

2. A vehicle, especially a wheeled vehicle, for transporting and placing bridge parts of a portable bridge, which comprises:

a frame;

a cab mounted on the forward end of said frame; and a support unit pivotally mounted on said frame for use in placing said bridge parts, said support unit in transport position being located behind said cab, and, in the placement position, being spaced from and in front of said cab and being adapted to contact the ground, said support unit being pivotal from said transport position to said placement position, and vice versa, said support unit comprising a cross member mounted on said frame directly behind said cab, two swivel arms respectively pivotally mounted on said cross member about vertical axes, and two supports, each of which is respectively mounted on one of said swivel arms, said supports being lowerable from a retracted position onto the ground for supporting said vehicle, and a crosspiece for selectively interconnecting and disconnecting said supports.

3. A vehicle according to claim 2, in which said vehicle has a front and rear axle unit located behind said cab, and in which said swivel arms are of such a length that, in the transport position, said supports are located between said front and rear axle units.

4. A vehicle according to claim 2, in which said crosspiece is provided with two track rollers for laterally guiding and facilitating in the advancement of said bridge parts.

5. A vehicle according to claim 2, in which said crosspiece is pivotally connected to one of said two swivel arms at the level of said swivel arms and therebetween.

6. A vehicle according to claim 5, in which said crosspiece is connectable to the other of said two swivel arms by means of a stop.

* * * * *